US010920306B2

(12) United States Patent
Sumi et al.

(10) Patent No.: US 10,920,306 B2
(45) **Date of Patent: *Feb. 16, 2021**

(54) ALUMINUM ALLOY WIRE ROD AND PRODUCING METHOD THEREOF

(71) Applicant: HITACHI METALS, LTD., Tokyo (JP)

(72) Inventors: Toru Sumi, Tokyo (JP); Kazuya Nishi, Tokyo (JP); Shohei Hata, Tokyo (JP); Takashi Hayasaka, Tokyo (JP); Takeshi Usami, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 211 days.

This patent is subject to a terminal disclaimer.

(21) Appl. No.: 16/191,622

(22) Filed: Nov. 15, 2018

(65) Prior Publication Data

US 2019/0345594 A1 Nov. 14, 2019

(30) Foreign Application Priority Data

May 9, 2018 (JP) ..... 2018-090930
May 9, 2018 (JP) ..... 2018-090931

(51) Int. Cl.
*C22C 21/00* (2006.01)
*C22F 1/04* (2006.01)
*H01B 1/02* (2006.01)

(52) U.S. Cl.
CPC ..... *C22F 1/04* (2013.01); *C22C 21/00* (2013.01); *H01B 1/023* (2013.01)

(58) Field of Classification Search
CPC ..... C22F 1/04; H01B 1/023; C22C 21/00
See application file for complete search history.

(56) References Cited

U.S. PATENT DOCUMENTS 9,564,254 B2 2/2017 Kobayashi et al.
10,192,649 B2 * 1/2019 Nishi ..... C22F 1/04
(Continued)

FOREIGN PATENT DOCUMENTS

CA 967405 A 5/1975
JP 48-000014 A 1/1973
(Continued)

OTHER PUBLICATIONS

Japanese Office Action dated Jul. 3, 2018 for the Japanese Patent Application No. 2017-039174.

*Primary Examiner* — Scott R Kastler
(74) *Attorney, Agent, or Firm* — Foley & Lardner LLP

(57) ABSTRACT

An aluminum alloy wire rod has a chemical composition consisting of 0.1 to 1.0 mass % of Co, 0.2 to 0.5 mass % of Zr, 0.02 to 0.09 mass % of Fe, 0.02 to 0.09 mass % of Si, 0 to 0.2 mass % of Mg, 0 to 0.10 mass % of Ti, 0 to 0.03 mass % of B, 0 to 1.00 mass % of Cu, 0 to 0.50 mass % of Ag, 0 to 0.50 mass % of Au, 0 to 1.00 mass % of Mn, 0 to 1.00 mass % of Cr, 0 to 0.50 mass % of Hf, 0 to 0.50 mass % of V, 0 to 0.50 mass % of Sc, 0 to 0.50 mass % of Ni, the balance being Al and inevitable impurities, and a metal structure including Al crystal grains, an Al—Co—Fe compound and an Al—Zr compound. The Al crystal grains having a crystal grain diameter of 10 μm or less have an area ratio of 90% or more. The wire rod has a tensile strength of 150 MPa or more, an electrical conductivity of 55% IACS or more and when heated at 200 deg C. for 10 years, a strength of 90% or more of its initial state strength.

25 Claims, 3 Drawing Sheets

(56) References Cited

U.S. PATENT DOCUMENTS

| | | | | |
|---|---|---|---|---|
| 2013/0264115 | A1 | 10/2013 | Kobayashi et al. | |
| 2015/0235729 | A1 | 8/2015 | Yoshida et al. | |
| 2017/0098487 | A1 | 4/2017 | Kobayashi et al. | |
| 2017/0213619 | A1* | 7/2017 | Sekiya | B22D 21/007 |
| 2019/0345594 | A1* | 11/2019 | Sumi | C22F 1/04 |

FOREIGN PATENT DOCUMENTS

| | | | |
|---|---|---|---|
| JP | 52-035114 | A | 3/1977 |
| JP | 2012-229485 | A | 11/2012 |
| JP | 2012-229485 | A | 11/2012 |
| JP | 2016-108617 | A | 6/2016 |
| WO | WO-2014/155820 | A1 | 10/2014 |
| WO | WO-2016/088888 | A1 | 6/2016 |

* cited by examiner

ALUMINUM ALLOY WIRE ROD AND PRODUCING METHOD THEREOF

CROSS-REFERENCE TO RELATED APPLICATIONS

The present application is based on Japanese patent application No. 2018-090930 filed on May 9, 2018 and Japanese patent application No. 2018-090931 filed on May 9, 2018, the entire contents of which are incorporated herein by reference.

BACKGROUND OF THE INVENTION

1. Field of the Invention

The present invention relates to an aluminum alloy wire rod and a producing method thereof.

2. Description of the Related Art

In rolling stocks, automobiles, other electrical appliances and the like, electric wires and cables having a conductor made of copper or a copper alloy are used as wiring materials. For these electric wires and cables, there is a great demand for weight reduction from the viewpoint of reducing energy consumption in automobiles and the like. Therefore, in recent years, it has been studied to use a conductor made of aluminum or an aluminum alloy having a smaller specific gravity than that of copper or a copper alloy for the electric wires and cables used for these applications.

For example, JP-A-2012-229485 proposes a method in which alloying elements of magnesium (Mg), zirconium (Zr), or the like are added in an aluminum alloy and these elements are precipitated by aging. In JP-A-2012-229485, it is disclosed that the strength, elongation, electrical conductivity and heat resistance of a conductor can be improved by adopting such an aluminum alloy as that conductor. Note that the heat resistance in JP-A-2012-229485 means that the strength is 150 MPa or more when held at temperatures from room temperature to 150 deg C. for 1,000 hours.

SUMMARY OF THE INVENTION

Now, in the case of electric wires and cables used for rolling stocks and the like, when the aluminum or the aluminum alloy is used for the conductor, the cross sectional area of the conductor is larger than when the copper is applied for the conductor. In moving bodies such as rolling stocks, the wiring space for wiring the electric wires and cables is limited, so it is desired that the cross-sectional area of the conductor made of the aluminum or the aluminum alloy is made as small as possible and the electric wires and cables are wired in the same wiring space as the conventional wiring space. However, when reducing the cross-sectional area of the conductor made of the aluminum or the aluminum alloy, it has been difficult to obtain the strength, elongation, electrical conductivity and heat resistance in a well-balanced manner at a high level.

It is an object of the present invention to provide an aluminum alloy wire rod having its strength, elongation, electrical conductivity and heat resistance in a well-balanced manner at a high level.

According to one aspect of the present invention, there is provided a wire rod made of an aluminum alloy, the aluminum alloy having a chemical composition consisting of 0.1 to 1.0 mass % of Co, 0.2 to 0.5 mass % of Zr, 0.02 to 0.09 mass % of Fe, 0.02 to 0.09 mass % of Si, 0 to 0.2 mass % of Mg, 0 to 0.10 mass % of Ti, 0 to 0.03 mass % of B, 0 to 1.00 mass % of Cu, 0 to 0.50 mass % of Ag, 0 to 0.50 mass % of Au, 0 to 1.00 mass % of Mn, 0 to 1.00 mass % of Cr, 0 to 0.50 mass % of Hf, 0 to 0.50 mass % of V, 0 to 0.50 mass % of Sc, 0 to 0.50 mass % of Ni, the balance being Al and inevitable impurities, wherein the aluminum alloy has a metal structure including Al crystal grains, an Al—Co—Fe compound and an Al—Zr compound, and wherein an area ratio of a region occupied by the Al crystal grains having a crystal grain diameter of 10 μM or less is 90% or more.

According to another aspect of the present invention, there is provided a method of producing a wire rod made of an aluminum alloy, the method comprising:

preparing a molten metal consisting of 0.1 to 1.0 mass % of Co, 0.2 to 0.5 mass % of Zr, 0.02 to 0.09 mass % of Fe, 0.02 to 0.09 mass % of Si, 0 to 0.2 mass % of Mg, 0 to 0.10 mass % of Ti, 0 to 0.03 mass % of B, 0 to 1.00 mass % of Cu, 0 to 0.50 mass % of Ag, 0 to 0.50 mass % of Au, 0 to 1.00 mass % of Mn, 0 to 1.00 mass % of Cr, 0 to 0.50 mass % of Hf, 0 to 0.50 mass % of V, 0 to 0.50 mass % of Sc, 0 to 0.50 mass % of Ni, the balance being Al and inevitable impurities;

casting the molten metal by quenching at such a cooling rate as to crystallize Co while suppressing crystallization of Zr, to form a cast material containing an Al—Co—Fe compound;

drawing the cast material to form a drawn wire rod; and subjecting the drawn wire rod to an aging treatment to precipitate Zr forming a solid solution in an Al phase as an Al—Zr compound, wherein the aluminum alloy has the above mentioned chemical composition and has a metal structure including Al crystal grains, an Al—Co—Fe compound and an Al—Zr compound, and wherein an area ratio of a region occupied by the Al crystal grains having a crystal grain diameter of 10 μm or less is 90% or more.

According to another aspect of the invention, there is provided a wire rod made of an aluminum alloy, the aluminum alloy having a chemical composition consisting of 0.1 to 1.0 mass % of Co, 0.2 to 0.5 mass % of Zr, 0.02 to 0.09 mass % of. Fe, 0.02 to 0.09 mass % of Si, 0 to 0.2 mass % of Mg, 0 to 0.10 mass % of Ti, 0 to 0.03 mass % of B, 0 to 1.00 mass % of Cu, 0 to 0.50 mass % of Ag, 0 to 0.50 mass % of Au, 0 to 1.00 mass % of Mn, 0 to 1.00 mass % of Cr, 0 to 0.50 mass % of Hf, 0 to 0.50 mass % of V, 0 to 0.50 mass % of Sc, 0 to 0.50 mass % of Ni, the balance being Al and inevitable impurities, wherein the aluminum alloy has a metal structure including Al crystal grains, an Al—Co—Fe compound and an Al—Zr compound, and the wire rod has a tensile strength of 150 MPa or more, an electrical conductivity of 55% IACS or more and when heated at 200 deg C. for 10 years, a strength of 90% or more of its initial state strength.

According to another aspect of the present invention, there is provided a method of producing a wire rod made of an aluminum alloy, the method comprising:

preparing a molten metal consisting of 0.1 to 1.0 mass % of Co, 0.2 to 0.5 mass % of Zr, 0.02 to 0.09 mass % of Fe, 0.02 to 0.09 mass % of Si, 0 to 0.2 mass % of Mg, 0 to 0.10 mass % of Ti, 0 to 0.03 mass % of B, 0 to 1.00 mass % of Cu, 0 to 0.50 mass % of Ag, 0 to 0.50 mass % of Au, 0 to 1.00 mass % of Mn, 0 to 1.00 mass % of Cr, 0 to 0.50 mass % of Hf, 0 to 0.50 mass % of V, 0 to 0.50 mass % of Sc, 0 to 0.50 mass % of Ni, the balance being Al and inevitable impurities;

casting the molten metal by quenching at such a cooling rate as to crystallize Co while suppressing crystallization of Zr, to form a cast material containing an Al—Co—Fe compound;

drawing the cast material to form a drawn wire rod; and subjecting the drawn wire rod to an aging treatment to precipitate Zr forming a solid solution in an Al phase as an Al—Zr compound, wherein the aluminum alloy has the above mentioned chemical composition and has a metal structure including Al crystal grains, an Al—Co—Fe compound and an Al—Zr compound, wherein the wire rod has a tensile strength of 150 MPa or more, an electrical conductivity of 55% IACS or more and when heated at 200 deg C. for 10 years, a strength of 90% or more of its initial state strength.

Points of the Invention

According to the present invention, it is possible to obtain the aluminum alloy wire rod having its strength, elongation, electrical conductivity and heat resistance in a well-balanced manner at a high level.

DETAILED DESCRIPTION OF THE PREFERRED EMBODIMENTS

Figure 1:
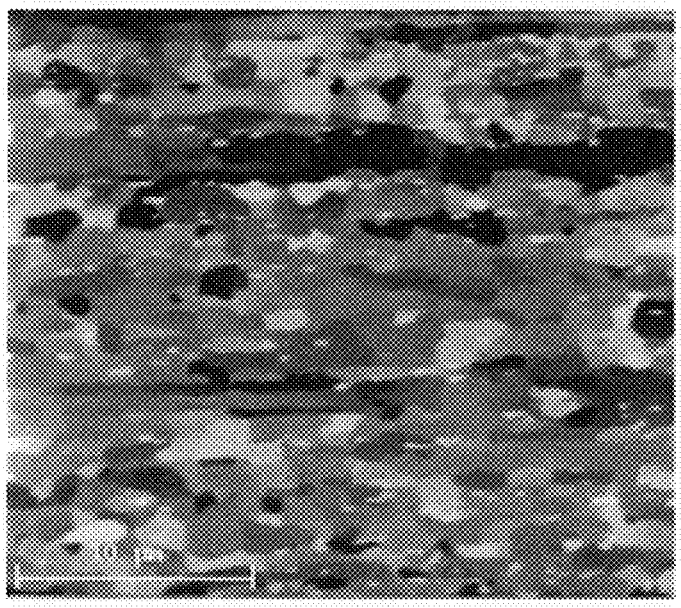
FIG. 1 is an SIM (secondary ion microscope) image of a cross section perpendicular to a longitudinal direction of an aluminum alloy wire rod of Example 4.

In order to solve the above-mentioned problems, the inventors of the present invention examined changes in various properties when the chemical composition of an aluminum alloy is changed by appropriately changing the types of alloy elements, producing conditions, and the like. As a result, it was found that by using Co and Zr as alloying elements, the strength, elongation, electrical conductivity and heat resistance can be obtained in a well-balanced manner at a high level in the aluminum alloy wire finally obtained. The present invention was made based on this finding.

<Aluminum Alloy Wire Rod>

Hereinafter, an aluminum alloy wire rod according to one embodiment of the present invention will be described. Note that herein, the numerical range expressed by using "to" (or "-") means a range including numerical values described before and after "to" (or "-") as a lower limit value and an upper limit value.

(Chemical Composition)

First, the chemical composition of an aluminum alloy (hereinafter also simply referred to as an "alloy") constituting an aluminum alloy wire rod (hereinafter simply referred to as an "alloy wire rod") will be described.

The chemical composition of the alloy is consisting of 0.1 to 1.0 mass % of Co, 0.2 to 0.5 mass % of Zr, 0.02 to 0.09 mass % of Fe, 0.02 to 0.09 mass % of Si, 0 to 0.2 mass % of Mg, 0 to 0.10 mass % of Ti, 0 to 0.03 mass % of B, 0 to 1.00 mass % of Cu, 0 to 0.50 mass % of Ag, 0 to 0.50 mass % of Au, 0 to 1.00 mass % of Mn, 0 to 1.00 mass % of Cr, 0 to 0.50 mass % of Hf, 0 to 0.50 mass % of V, 0 to 0.50 mass % of Sc, 0 to 0.50 mass % of Ni, the balance being Al and inevitable impurities.

The Co is an essential component to be added to the alloy wire rod. As will be described later, most of the Co reacts with Al in the producing process (casting/solidifying) of the alloy wire rod to form a crystallized substance (Al—Co compound), and as a finally obtained alloy wire rod, it exists as a compound phase. In fact, the Al—Co compound is present in the form of an Al—Co—Fe compound which has absorbed Fe inevitably present in the aluminum alloy. The Al—Co—Fe compound contributes to refinement of Al recrystallized grains of the alloy and improves the elongation of the alloy wire rod. Co may lower the electrical conductivity of the alloy, but by setting the content of Co at 0.1 mass % to 1.0 mass %, it is possible to obtain the effect of having the strength, elongation and heat resistance due to Co at a high level in a well-balanced manner while suppressing the decrease in the electrical conductivity due to Co in the alloy wire rod. The Co content is preferably from 0.2% by mass to 1.0% by mass, and more preferably from 0.3% by mass to 0.8% by mass.

Like Co, Zr is an essential component to be added at the time of producing the alloy wire rod. As will be described later, Zr exists in a solid solution state in an ingot (cast material) after casting, but precipitates as an Al—Zr compound in the alloy wire rod after aging heat treatment. The Al—Zr compound mainly contributes to improving the heat resistance of the alloy wire rod. If the content of Zr is excessively increased, the ductility of the alloy may be lowered during the producing process of the alloy wire rod, which may hinder the diameter reduction of the alloy wire rod. In this regard, by setting the content of Zr at 0.2% by mass to 0.5% by mass, it is possible to maintain the ductility of the alloy at a high level and obtain the desired heat resistance of the alloy wire rod. The Zr content is more preferably 0.3% by mass to 0.4% by mass.

Fe is a component inevitably incorporated derived from the aluminum raw material. Fe contributes to improving the strength of the alloy. If Fe crystallizes as $FeAl_3$ during casting or precipitates as $FeAl_3$ during aging heat treatment, the ductility of the alloy decreases, which may hinder the reduction of the diameter of the alloy wire during production. In the present embodiment, by incorporating Co, the Al—Co—Fe compound is formed by absorbing Fe when the Al—Co compound is crystallized. Thus, by forming Fe as the Al—Co—Fe compound, the formation of $FeAl_3$ is suppressed. As a result, it is possible to improve the strength of the alloy while suppressing deterioration of the ductility of the alloy. From the viewpoint of absorbing Fe into the Al—Co compound, the Fe content is preferably not more than the content of Co, and is preferably 0.02 mass % to 0.09 mass %. As a result, it is possible to obtain high strength while reducing the diameter of the alloy wire rod. The Fe content is preferably 0.04% by mass to 0.09% by mass. It is to be noted that Fe may be added so as to have a predetermined content.

Like Fe, Si is a component inevitably incorporated derived from the aluminum raw material. Si forms a solid solution in the Al crystal grains of the alloy or precipitates together with Fe, thereby contributing to the improvement of the strength of the alloy. Si, like Fe, may lower the elongation of the alloy or hinder the diameter reduction of the alloy wire, but when the Si content is set at 0.02 mass % to 0.09 mass %, it is possible to improve the strength while suppressing the decrease in elongation of the alloy. The Si content is preferably 0.04% by mass to 0.08% by mass. Note that Si may be added so as to have a predetermined content.

Mg, Ti, B, Cu, Ag, Au, Mn, Cr, Hf, V, Sc and Ni are optional components taken in derived from the aluminum raw material, or appropriately added as necessary. Here, the optional component refers to a component which may or may not be contained. Each alloy element suppresses the coarsening of crystal grains of the Al phase in the alloy wire rod and contributes to the improvement of its strength. Among them, Cu, Ag, and Au are precipitated at grain boundaries and the grain boundaries strength can also be improved. When the content of each alloying element is set within the above ranges, reduction in elongation of the alloy can be suppressed and effects of each alloying element can be obtained.

The balance (i.e. the remainder other than the above-mentioned components) is Al and inevitable (unavoidable) impurities. Here, the inevitable impurities are inevitably taken in due to the producing process of the alloy wire rod, and refer to inevitable impurities having a small content so as not to affect the characteristics of the alloy wire rod. Examples of the inevitable impurities include Ga, Zn, Bi, Pb and the like.

From the viewpoint of the electrical conductivity of the alloy wire, the Al content is preferably 97% by mass or more, more preferably 98% by mass or more, further preferably 98.4% by mass or more.

(Metal Structure)

Subsequently, the metal structure (i.e. metal structure, metallographic structure, metallurgical structure) of the aluminum alloy will be described.

The metal structure of the alloy contains Al crystal grains, an Al—Co—Fe compound composed of crystallized substances (crystallized products) or precipitates, and an Al—Zr compounds, and is composed of these compounds finely dispersed.

Also, from the viewpoint of realizing the strength, elongation, electrical conductivity and heat resistance of the alloy at a higher level, it is preferable that the metal structure of the alloy is a fine crystal structure in which the compound is finely dispersed. Specifically, the metal structure of the alloy preferably has an area ratio of a region occupied by Al crystal grains having a maximum crystal grain diameter of 10 μm or less being 90% or more in a cross section parallel to a longitudinal direction of the wire rod. In the metal structure having such an area ratio, most of the Al crystal grains are fine crystals of 10 μm or less, so crystal grain boundaries formed between the crystal grains form a fine mesh structure. The existence of two kinds of compounds, the Al—Co—Fe compound and the Al—Zr compound, in such crystal grain boundaries and their vicinal regions makes it possible for the compounds to be finely and uniformly dispersed in the metal structure.

As described above, the alloy of the present embodiment has the metal structure in which the two kinds of different compounds are finely and uniformly dispersed.

Here, the crystallized substance refers to a compound formed in the step of solidifying the molten metal by cooling at the time of casting the aluminum alloy, or the step of cooling the high temperature cast material to around room temperature after solidification. That is, the crystallized substance is a compound formed in the aluminum alloy at the stage of the cast material.

In addition, the precipitate is a compound formed at the stage of heating and holding the cast material cooled to room temperature by aging treatment under a high temperature atmosphere below the melting point. Specifically, it is a compound that is formed for the first time as the metal element forming a solid solution in the Al phase of the cast material diffuses and aggregates into the Al phase by aging treatment. In other words, the precipitate is not present in the Al alloy at the stage of the cast material but exists at the stage of the alloy wire rod after the aging treatment.

Further, the crystal grain diameter means the maximum value of the grain diameter of the Al crystal grain in the cross section along the longitudinal direction of the aluminum alloy wire rod in which the Al crystal grain, the Al—Co—Fe compound and the Al—Zr compound exist in the metal structure.

In the metal structure, it is preferable that the number of Al—Co—Fe compounds per unit area (hereinafter also simply referred to as "number density") in the cross section perpendicular to the longitudinal direction of the alloy wire rod is 50/100 $\mu m^2$ or more. By dispersing the Al—Co—Fe compound at such a number density, it is possible to finely disperse the compound in the metal structure, and it is possible to obtain various properties in the alloy wire rod at a higher level in a well-balanced manner.

In the metal structure, it is preferable that the number (number density) per unit area of the Al—Zr compound is 500/100 $\mu m^2$ in the cross section perpendicular to the longitudinal direction of the alloy wire rod. By dispersing the Al—Zr compound at such a number density, it is possible to finely disperse the compound in the metal structure, and it is possible to obtain various properties at a high level and in a well-balanced manner in the alloy wire rod.

In the metal structure, the size of the Al—Zr compound is preferably 5 nm or more and 100 nm or less. By decreasing the amount of precipitates, even when the content of alloying elements is reduced, the number of precipitates can be increased, and the effects of precipitates can be obtained in a well-balanced manner. In addition, since the ductility of the alloy can be kept high, the degree of working can be increased in the wire drawing process, and the diameter of the alloy wire rod can be further reduced.

In addition, in the metal structure, the size of the Al—Co—Fe compound is preferably 20 nm or more and 500 nm or less. Like the Al—Zr compound, it is preferable to reduce the particle diameter of the Al—Co—Fe compound. Note that since Co atoms diffuse faster than Zr atoms in the Al texture, the size of the Al—Co—Fe compound is larger than that of the Al—Zr compound. As described later, the role of the Al—Co—Fe compound is to suppress the growth of recrystallized grains at the initial stage of the aging heat treatment. For this reason, there is no problem that the size of the Al—Co—Fe compound exceeds that of the Al—Zr compound in the metal structure after the aging heat treatment is completed.

Further, although the shape of the compound is not particularly limited, it is preferable that the Al—Co—Fe compound has a spherical shape or a spheroid shape. The Al—Zr compound is preferably spherical, but there is no problem even if it has an indefinite shape. Note that the spheroid shape is a circular shape in the direction perpendicular to the longitudinal direction of the wire rod and a shape that is elliptical in the direction parallel to the longitudinal direction of the wire rod.

(Characteristics of Aluminum Alloy Wire Rod)

The aluminum alloy wire rod of the present embodiment is formed from an aluminum alloy having the above-described chemical composition and metal structure, and has its strength, elongation, electrical conductivity and heat resistance at a high level in a well-balanced manner. Specifically, the alloy wire rod has a tensile strength at room temperature of 150 MPa or more and a tensile elongation of 8% or more. It also has an electrical conductivity of 50% IACS or higher. Further, it has such a heat resistance that the strength when it is heated at 200 deg C. for 10 years is 90% or more of the strength of the initial state. Note that the "heat resistance that the strength when heated at 200 deg C. for 10 years is 90% or more of the strength in the initial state" means that when based on the isothermal softening curve of the tensile strength obtained by heating the aluminum alloy wire rod at a specific temperature and time, Arrhenius plotting the temperature (for example, any temperature in the range of 300 deg C. to 400 deg C.) and the time (for example, any time in the range of 600 sec to 3,000,000 sec) at which the tensile strength of the aluminum alloy wire rod decreases by 10% from the tensile strength before heating (initial tensile strength), the time when the temperature in the Arrhenius plot is 200 deg C. (the time when the tensile strength decreases by 10%) is 10 years or more. Specifically, it can be obtained by the heat resistance evaluation method in Examples described later.

Although the wire diameter of the alloy wire rod is not particularly limited, it is preferably 2 mm or less, more preferably 0.3 mm to 1 mm from the viewpoint of flexibility. In the present embodiment, by making the alloy of a predetermined configuration, it is possible to obtain various characteristics at a high level in a well-balanced manner while setting the wire diameter at 2 mm or less.

<Method for Producing Aluminum Alloy Wire Rod>

Subsequently, a method for producing the above-described aluminum alloy wire rod will be described. The aluminum alloy wire rod of the present embodiment can be produced by sequentially performing a melt preparation step, a casting step, a molding step, a wire drawing step and an aging treatment step. Each step will be described in detail below.

(Preparation Step)

First, a molten metal for forming an aluminum alloy wire rod is prepared. In this embodiment, an Al raw material, a Co raw material, a Zr raw material and, if necessary, other alloy raw materials are mixed and melted so that the molten metal has the above-mentioned chemical composition. The method of mixing and melting the raw materials is not particularly limited, but can be carried out by a conventionally known method.

(Casting Step)

Subsequently, the molten metal is cast to form a cast material. In the present embodiment, the molten metal is solidified by quenching (rapid cooling) at a cooling rate so as to crystallize Co while suppressing crystallization of Zr. Thereby, the Al—Co—Fe compound is crystallized to form a cast material in which the Al—Co—Fe compound is dispersed.

Here, the findings obtained by the present inventors on the difference in behavior of Co and Zr due to quenching at the casting stage will be described.

According to the investigation by the present inventors, it was found that Co and Zr are different in the diffusion rate in aluminum solid phase, and are different in the easiness of crystallization and precipitation (precipitation speed).

Specifically, the diffusion rate of Co in the Al solid phase is equal to or higher than the self-diffusion rate of Al. Moreover, the solid solubility in the Al phase in the thermal equilibrium state of Co is as very small as less than 0.05% at maximum. Therefore, even immediately after casting and solidifying from the molten metal, Co easily aggregates and easily crystallizes in the Al structure. As a result of crystallization, most of Co will crystallize as a compound in the Al structure at the stage of the ingot (cast material) after casting.

Further besides the compound crystallized out in the Al phase immediately after solidification, Co atoms forming a solid solution also exist. Immediately after solidification, supersaturated Co atoms, which are more than thermal equilibrium solid solubility, form a solid solution in the Al phase. However, by rapidly diffusing Co atoms in the Al phase, Co atoms forming a solid solution in a supersaturated state aggregate in a relatively short time to form a compound phase. As a result, most of the added Co atoms exist as a compound phase with Al, until the cast material is cooled to room temperature after casting and solidification, and the Co atoms that form a solid solution in the Al phase remain in a small amount of less than 0.1% close to the thermal equilibrium concentration.

On the other hand, the diffusion rate of Zr in the Al phase is significantly lower than the self-diffusion rate of Al, and the deposition rate in the Al structure is lower than that of Co. Moreover, the maximum solid solubility of Al in the Al phase in the thermal equilibrium state of Zr is on the order of 0.3 to 0.4%, several times larger than that of Co. Therefore, Zr is difficult to crystallize at the stage of the cast material after casting, and most of it is present in a state of supersaturated solid solution in the Al structure. Also, since Zr diffuses remarkably slower than Co, even when the cast material after casting is stored at room temperature for a long time, the supersaturated solid solution state is maintained as it is. Zr in the supersaturated solid solution state can be precipitated by aging treatment, for example, by heating at a temperature of 300 deg C. or higher.

The present inventors focused attention on this difference in deposition rate and investigated. As a result, as the rate of cooling the molten metal is increased, crystallization of Zr is suppressed and the state of Zr forming a solid solution can be maintained while most of Co is crystallized as the Al—Co—Fe compound in the resulting cast material. According to such a cast material, wire breaking can be suppressed even when wire drawing is performed with a high degree of working as compared with the cast material in which Zr is crystallized, and the alloy wire rod having a small wire diameter can be produced.

In the cast material, since Co forms an Al—Co—Fe compound with Fe in the molten metal, there are few Fe in the solid solution state, which causes a decrease in electrical conductivity, and there are few precipitates ($FeAl_3$) which cause reduction in elongation. Meanwhile, the Al—Co—Fe compound formed in the cast material is dispersed in the Al structure so it is possible to prevent the Al crystal grains from becoming coarse due to recrystallization in the aging heat treatment stage described later. In the present embodiment, finely dispersing the Al—Co—Fe compound makes it possible to further suppress the coarsening of the crystal grains in the aging treatment step and maintain the crystal grain diameter of the crystal grains to be smaller.

Note that since the Al—Co—Fe compound does not lower the ductility of the Al alloy like the $FeAl_3$ compound, it does not hinder the diameter reduction of the alloy wire rod. Note that the Al—Co—Fe compound is a compound containing at least Al, Co, and Fe, and may contain other metal elements. Also, the Al—Co—Fe compound has an elongated shape in the cast ingot.

In the casting step, the cooling rate is preferably 1 deg C./s (degrees C./second) to 60 deg C./s, and more preferably 20 deg C./s to 50 deg C./s.

Further, in the present embodiment, from the viewpoint of reducing the size of the Al—Co—Fe compound and suppressing the segregation of the solid solution Zr, it is preferable that a Propertech continuous casting machine capable of casting by quenching the molten metal, a twin roll casting machine, or the like is used to perform billet casting or continuous casting.

(Molding Step)

Subsequently, if necessary, the cast material is formed into a rod shape (so-called "rough drawn wire") so that the cast material can be easily drawn. Here, for example, the cast material is machined so that the wire diameter is 5 mm to 50 mm. Conventionally known methods such as rolling, swaging, and pulling out may be used as the machining.

(Wire Drawing Step)

Subsequently, the rod-shaped cast material is cold wire drawn and processed into a drawn wire rod of a predetermined wire diameter. During this wire drawing, the Al—Co—Fe compound dispersed in the cast material is pulverized finely and simultaneously stretched on a flat plate in the drawing direction. By more finely and densely dispersing the Al—Co—Fe compound, coarsening of crystal grains in the aging treatment step described later can be more reliably suppressed. As the wire drawing processing, it is preferable to perform the wire drawing processing by a conventionally known method such as a pulling out wire drawing using a die, for example. Note that the degree of processing is the ratio of the cross-sectional area of the drawn wire rod material to the cross-sectional area of the cast material, and refers to the reduction ratio in the wire drawing process.

In the present embodiment, since the cast material is suppressed from crystallizing out of Zr and has high ductility, the workability of wire drawing can be increased. From the viewpoint of more finely pulverizing the Al—Co—Fe compound and finely dispersing it in the drawn wire rod, it is preferable that the cast material is drawn so that the cross sectional area becomes 0.01 times or less, and it is preferable to set the wire diameter of the drawn wire rod at 2.0 mm or less. With such a degree of processing, it becomes easier to control the size of the Al—Co—Fe compound after drawing at 20 nm to 500 nm. Further, when Zr is precipitated in the aging treatment step described later, the size of the Al—Zr compound can be easily controlled at 5 nm to 100 nm. Moreover, in the final alloy wire rod, the precipitate can be dispersed and precipitated more.

In this embodiment, since the cast material has high ductility, it is possible to omit an annealing process (so-called intermediate annealing process) for relaxing the working strain at the time of wire drawing. As a result, coarsening due to recrystallization of Al crystal grains can be further suppressed.

(Aging Treatment Step)

Subsequently, an aging treatment is applied to the drawn wire rod. As the aging treatment, for example, the drawn wire rod is preferably heated in the temperature range of 270 deg C. to 440 deg C., and the treatment time is preferably set at 10 hours or more. By aging treatment, Zr forming a solid solution in the Al phase in the drawn wire rod is precipitated as the Al—Zr compound. The Al—Zr compound is a compound containing at least Al and Zr, and may contain other metal elements. Note that during aging treatment, Co forming a solid solution in the Al alloy constituting the drawn wire rod also precipitates to form an Al—Co—Fe compound in some cases.

In the aging treatment, the Al crystal grains recrystallize by heating, but in this embodiment, since the Co compound is finely dispersed in the drawn wire rod, coarsening of the Al crystal grains is suppressed by this grain, and most of the Al crystal grains can be kept at a minute size (for example, a crystal grain diameter of 10 μm or less).

From the viewpoint of obtaining various characteristics at a higher level in a well-balanced manner, the size of Al crystal grains is maintained finely so that the area ratio of a region occupied by the Al crystal grains having a crystal grain diameter of 10 μm or less is 90% or more.

Moreover, during the aging treatment, Zr forming a solid solution in the Al phase moves to the grain boundaries and precipitates, but in the present embodiment, since the Al crystal grains are minute and the grain boundaries formed therebetween have a fine mesh structure, the distance until Zr moves from the Al phase to the grain boundaries is short, and precipitation of Zr at the crystal grain boundaries can be accelerated. Therefore, precipitates of Zr can be finely dispersed and precipitated in the drawn wire rod as a minute size (for example, 10 nm to 100 nm).

As described above, the wire rod material of the present embodiment is obtained by subjecting the drawn wire rod to aging treatment.

Effect According to this Embodiment

According to the present embodiment, one or more of the following effects are exhibited.

In the present embodiment, the molten metal having the above-described chemical composition is quenched at a cooling rate so as to crystallize Co while suppressing crystallization of Zr. As a result, when solidifying the molten metal, Co is dispersed in the solidified structure as an Al—Co—Fe compound. In addition, crystallization is suppressed by setting Zr in a solid solution state in the Al phase. By drawing this cast material, a drawn wire rod is formed in which the Al—Co—Fe compound is pulverized, refined, and uniformly dispersed. By subjecting this drawn wire rod to an aging treatment, Zr forming a solid solution in the Al phase is precipitated as an Al—Zr compound. In the aging treatment, along with the precipitation of Zr, the Al crystal grains recrystallize by heating, but the Al—Co—Fe compound finely dispersed in the drawn wire rod suppresses coarsening due to the recrystallization of the Al crystal grains, and the Al recrystallized grains can be kept small. In addition, since most of the Zr precipitates in the crystal grain boundaries between the minute Al recrystallized grains and in grains near the grain boundaries, they are finely dispersed. As described above, in the present embodiment, the wire drawing and the aging treatment are applied to the cast material rapidly cooled at a predetermined cooling rate, whereby it is possible to obtain the alloy wire rod in which the Al recrystallized grains are small and each compound of Al—Co—Fe and Al—Zr is finely dispersed.

The obtained alloy wire rod has the above chemical composition and contains the Al crystal grains and as dispersed particles the Al—Co—Fe compound and the Al—Zr compound, and in the cross section parallel to the longitudinal direction of the alloy wire rod, has a metal structure in which the area ratio of the area occupied by the Al crystal grains having a maximum crystal grain diameter of 10 μm or less is 90% or more. In the metal structure, there are many fine Al crystal grains, and the crystal grain boundaries formed between the crystal grains have a fine mesh structure, and the compound is dispersed on the grain boundaries.

The alloy wire having such a metal structure has the following characteristics. That is, since Fe is dispersed in the form of an Al—Co—Fe compound instead of a $FeAl_3$ compound, a decrease in strength and elongation due to $FeAl_3$ is suppressed. In addition, by absorbing Fe in the compound, Fe forming a solid solution in the Al phase is lessened, and high conductivity can be maintained. Further, since the Al—Zr compound is precipitated, high heat resistance can be obtained. Furthermore, by finely dispersing each compound of Al—Co—Fe and Al—Zr in the alloy with the Al crystal grain as a minute size, it is possible to obtain the effects of each compound particle at a high level in a well-balanced manner. Therefore, according to the alloy wire rod of the present embodiment, it is possible to obtain strength, elongation, electrical conductivity and heat resistance in a well-balanced manner at a high level.

Further, it is preferable that the alloy wire rod has a metal structure having an area ratio of a region occupied by Al crystal grains having a crystal grain diameter of 10 μm or less being 90% or more in a cross section parallel to the longitudinal direction of the alloy wire rod. The larger the area ratio is, the more the fine Al crystal grains exist in the metal structure, and the crystal grain boundaries formed between the crystal grains have a fine mesh structure. In the present embodiment, by forming the metal structure so that the Al crystal grains having a size of 10 μm or less are 90% or more in area ratio, the mesh structure of the crystal grain boundaries can be made finer, and the compound present in the crystal grain boundaries can be present in a more dispersed state. Thereby, it is possible to obtain strength, elongation, electrical conductivity and heat resistance in a well-balanced manner at a higher level.

Specifically, according to the alloy wire rod of the present embodiment, the tensile strength is 150 MPa or more, the tensile elongation is 8% or more, the electrical conductivity is 55% IACS or more, and the strength when heated at 200 deg C. for 10 years is 90% or more of its initial state strength, and it is possible to obtain strength, elongation, electrical conductivity and heat resistance at a high level in a well-balanced manner.

Further, in the cross section perpendicular to the longitudinal direction of the alloy wire rod, it is preferable that the number (number density) per unit area of the Al—Co—Fe compound is 50/100 $\mu m^2$ or more. In the alloy wire rod, the Al—Co—Fe compound is finely dispersed so as to have such a number density, so that the various characteristics of the alloy wire rod can be satisfied at a higher level.

Further, in the cross section perpendicular to the longitudinal direction of the alloy wire rod, the number (number density) per unit area of the Al—Zr compound is preferably 500/100 $\mu m^2$ or more. In the alloy wire rod, the Al—Zr compound is finely dispersed so as to have such a number density, so that the various characteristics of the alloy wire rod can be satisfied at a higher level.

Further, in the alloy wire rod, the size of the Al—Zr compound is preferably 5 nm or more and 100 nm or less. By reducing the size of the Al—Zr compound, it is possible to further improve the elongation of the alloy wire rod and to reduce the wire break rate in the producing process. As a result, the yield of the alloy wire rods can be improved.

Further, in the alloy wire rod, the size of the Al—Co—Fe compound is preferably 20 nm or more and 500 nm or less. When the size of the Al—Co—Fe compound falls within this range, the coarsening of the Al crystal grains can be suppressed efficiently.

In addition, in this embodiment, the crystallization of Zr in the cast material is suppressed, and its ductility is kept high. Therefore, it is possible to wire draw at high workability in the wire drawing process, and it is possible to reduce the diameter of the alloy wire while maintaining the balance of the various properties at a high level. Specifically, the wire diameter can be 2 mm or less.

In addition, in the present embodiment, since the crystallization of Zr in the cast material is suppressed and the ductility thereof is kept high, the wire break due to processing strain of the drawn wire rod can be reduced. In addition, since the drawn wire rod has high ductility, it is possible to omit the annealing treatment for relaxing the processing strain.

In addition, in this embodiment, it is preferable that the precipitates are spherical. Since the precipitates are spherical, cracks at the interface between the Al phase and the precipitate can be suppressed when stress concentrates on a part of the alloy wire rod by deformation, so it is possible to improve the ductility of the alloy wire rod.

In addition, in the present embodiment, when aging treatment is applied to the drawn wire rod, the crystallized Co suppresses recrystallization of the Al crystal grains and maintains the Al crystal grains at a small particle diameter. Therefore, since the crystal grain boundaries between the Al crystal grains have a fine mesh structure, it is possible to shorten the time until Zr forming a solid solution migrates from the Al phase to the grain boundaries and precipitates. As a result, it is possible to shorten the aging treatment and to improve the production efficiency of the alloy wire rod.

Further in the casting of the molten metal, the cooling rate is preferably 1 deg C./s to 60 deg C./s, more preferably 20 deg C./s to 50 deg C./s. By quenching the molten metal under such conditions, it is possible to more finely disperse Co and crystallize it while more reliably suppressing the crystallization of Zr. This makes it possible to obtain the balance of the various properties at a higher level.

Further at the time of wire drawing, it is preferable to draw the cast material at a working degree so that the cross-sectional area is 0.01 times or less. By wire drawing at such a degree of processing, the Al—Co—Fe compound that crystallizes in the cast material can be finely pulverized, miniaturized and homogeneously dispersed. As a result, in the aging treatment, the Al—Zr compound can be more finely dispersed and precipitated, and the balance of the various properties can be obtained at a higher level.

EXAMPLES

Next, the present invention will be described in more detail based on examples, but the present invention is not limited to these examples.

<Production of Alloy Wire Rod>

Example 1

In Example 1, aluminum, Co and Zr having a purity of 99.9% were compounded so that Co, Zr, Fe and Si had compositions shown in the following Table 1, and were melted in an argon atmosphere in a high-frequency melting furnace. A cast material having a predetermined chemical composition was obtained by casting the resulting molten metal in a copper water-cooled crucible. The solidification rate during casting was 25 deg C./s. The cast material had a cylindrical shape with an outer diameter of 30 mm and a length of 150 mm. This cast material was subjected to swaging to make a rough drawn wire of diameter 9.5 mm and was then repeatedly drawn by pulling out with a die to thin the wire to diameter 0.45 mm. No intermediate heat treatment during wire drawing with the die was carried out. The obtained wire rod of diameter 0.45 mm was held for 20 hours or longer in a salt bath heated and held at 300 deg C. to perform an aging heat treatment to make an alloy wire rod of Example 1.

TABLE 1

| | Chemical composition (mass %) | | | | Cooling rate | Elongation | Tensile strength | Conductivity | Heat | Fine crystal | Compound grain dispersion | |
|---|---|---|---|---|---|---|---|---|---|---|---|---|
| | Co | Zr | Fe | Si | (° C./s) | (%) | (MPa) | (% IACS) | resistance | structure | AlCoFe | AlZr |
| Example 1 | 1 | 0.4 | 0.06 | 0.05 | 25 | 8 | 187 | 54 | ○ | ○ | ○ | ○ |
| Example 2 | 0.8 | 0.4 | 0.06 | 0.05 | 25 | 11 | 181 | 55 | ○ | ○ | ○ | ○ |
| Example 3 | 0.6 | 0.5 | 0.06 | 0.05 | 25 | 10 | 185 | 54 | ○ | ○ | ○ | ○ |
| Example 4 | 0.6 | 0.4 | 0.06 | 0.05 | 25 | 12 | 179 | 56 | ○ | ○ | ○ | ○ |
| Example 5 | 0.5 | 0.4 | 0.06 | 0.05 | 25 | 12 | 176 | 56 | ○ | ○ | ○ | ○ |
| Example 6 | 0.3 | 0.4 | 0.06 | 0.05 | 25 | 8 | 164 | 56 | ○ | ○ | ○ | ○ |
| Example 7 | 0.3 | 0.5 | 0.06 | 0.05 | 25 | 8 | 183 | 54 | ○ | ○ | ○ | ○ |
| Example 8 | 0.8 | 0.3 | 0.06 | 0.05 | 25 | 14 | 162 | 56 | ○ | ○ | ○ | ○ |
| Example 9 | 0.8 | 0.2 | 0.06 | 0.05 | 25 | 18 | 155 | 57 | ○ | ○ | ○ | ○ |
| Example 10 | 0.6 | 0.4 | 0.09 | 0.05 | 25 | 11 | 174 | 55 | ○ | ○ | ○ | ○ |
| Example 11 | 0.6 | 0.4 | 0.06 | 0.08 | 25 | 10 | 179 | 56 | ○ | ○ | ○ | ○ |
| Example 12 | 0.6 | 0.4 | 0.06 | 0.09 | 25 | 8 | 175 | 55 | ○ | ○ | ○ | ○ |
| Example 13 | 0.6 | 0.4 | 0.06 | 0.05 | 8 | 11 | 151 | 58 | ○ | ○ | ○ | ○ |
| Example 14 | 0.6 | 0.4 | 0.06 | 0.05 | 12 | 14 | 159 | 57 | ○ | ○ | ○ | ○ |
| Example 15 | 0.6 | 0.4 | 0.06 | 0.05 | 20 | 13 | 169 | 56 | ○ | ○ | ○ | ○ |

Examples 2 to 12

In Examples 2 to 12, alloy wire rods were produced in the same manner as in Example 1 except that the chemical compositions of Co, Zr, Fe and Si were changed as shown in Table 1.

Examples 13 to 15

In Examples 13 to 15, alloy wire rods were produced in the same manner as in Example 4 except that the cooling rate was changed as shown in Table 1.

Comparative Examples 1 to 9

In Comparative Examples 1 to 9, alloy wire rods were produced in the same manner as in Example 1 except that the chemical compositions of Co, Zr, Fe and Si were changed as shown in Table 2 below.

(Evaluation Method)

As to the alloy wire rods thus prepared, the metal structure, form of compound dispersed in the metal structure, elongation, tensile strength, electrical conductivity, and heat resistance thereof were evaluated by following methods.

(Metal Structure)

The metal structures of the alloy wire rods were evaluated for fineness thereof based on the particle diameter distribution of the Al crystal grains. Specifically, firstly, after embedding the alloy wire rods in a resin, a cross section perpendicular to the longitudinal direction was exposed by polishing. Next, the cross sections thereof were observed by an SIM (Scanning Ion Microscope: Secondary Ion Microscope), and the obtained SIM images were subjected to image analysis. Then, from the image analysis results obtained, the area ratios occupied in the cross sections of the Al crystal grains of 10 μm or less and the Al crystal grains exceeding 10 μm were obtained, and the particle diameter

TABLE 2

| | Chemical composition (mass %) | | | | Cooling rate | Elongation | Tensile strength | Conductivity | Heat | Fine crystal | Compound grain dispersion | |
|---|---|---|---|---|---|---|---|---|---|---|---|---|
| | Co | Zr | Fe | Si | (° C./s) | (%) | (MPa) | (% IACS) | resistance | structure | AlCoFe | AlZr |
| Comparative example 1 | 0 | 0.4 | 0.06 | 0.05 | 25 | 4 | 149 | 56 | ○ | X | X | ○ |
| Comparative example 2 | 0.6 | 0 | 0.06 | 0.05 | 25 | 22 | 93 | 60 | X | X | ○ | X |
| Comparative example 3 | 0.5 | 0.1 | 0.06 | 0.05 | 25 | 18 | 113 | 60 | X | X | ○ | X |
| Comparative example 4 | 0.4 | 0.8 | 0.06 | 0.05 | 25 | 4 | 158 | 46 | ○ | X | ○ | ○ |
| Comparative example 5 | 0.6 | 0.6 | 0.06 | 0.05 | 25 | 6 | 166 | 48 | ○ | X | ○ | ○ |
| Comparative example 6 | 1.5 | 0.4 | 0.06 | 0.05 | 25 | 5 | 150 | 53 | ○ | X | ○ | ○ |
| Comparative example 7 | 0.6 | 0.4 | 0.3 | 0.05 | 25 | 4 | 182 | 52 | ○ | X | ○ | ○ |
| Comparative example 8 | 0.6 | 0.4 | 0.06 | 0.15 | 25 | 5 | 169 | 52 | ○ | X | ○ | ○ |
| Comparative example 9 | 0.6 | 0.4 | 0.06 | 0.2 | 25 | 4 | 165 | 51 | ○ | X | ○ | ○ |

distributions were measured. In the present examples, if the area ratio of the Al crystal grains of 10 μm or less was 90% or more, the metal structure was evaluated as having a fine crystal structure and was denoted by "○". On the other hand, if it was less than 90%, it was evaluated that it had no fine crystal structure and it was denoted by "×".

(Form of Compound)

In the form of the compound dispersed in the metal structures of the alloy wire rods, the cross section perpendicular to the longitudinal direction was exposed by polishing and that cross section was observed by an STEM (scanning transmission electron microscope). For observation, the STEM apparatus having a field emission (FE) type electron beam source was used to photograph a wide angle annular dark field image (HAADF) to observe fine particles including Co, Fe and Zr. In the present examples, the presence or absence and the number density of Al—Co—Fe compounds and Al—Zr compounds were measured. For the measurement of the number density, the number density was measured for each of five cross sections different in the longitudinal direction of the alloy wire rod, and the average thereof was calculated. In the present examples, the Al—Co—Fe compound was evaluated as "○" when the number density was 50/100 $\mu m^2$ or more, and "×" when the number density was less than 50. For the Al—Zr compound, it was evaluated as "○" if the number was 500/100 $\mu m^2$ or more, and "×" if it was less than 500.

(Elongation and Tensile Strength)

Elongations and tensile strengths of the alloy wire rods were measured by a tensile test of the alloy wire rod. In the present examples, when the elongation was 8% or more, it was evaluated that the elongation property was good. In addition, when the tensile strength was 150 MPa or more, it was evaluated that the strength was high.

(Electrical Conductivity)

The electrical conductivities of the alloy wire rods were calculated by measuring the electric resistances at 20 deg C. of the produced alloy wire rods by the direct current four terminal method. In the present example, if the electrical conductivity was 55% IACS or more, it was evaluated as having high conductivity.

(Heat Resistance)

The heat resistances of the alloy wire rods were evaluated for the presence or absence of such a heat resistance that the strength when heated at 200 deg C. for 10 years was 90% or more of the initial strength by the following method. At first, aging treatment was carried out on the alloy wire rods at different heating temperatures and heating times, and tensile strength was measured from the tensile test of the wire rods after the aging treatment. The tensile test was conducted on five wire rods of the same chemical compositions and aging conditions and the average of the five test results was adopted as the tensile strength. Next, the isothermal softening curves of the tensile strengths at various temperatures were made from heating temperature, heating time and tensile strength values. Next, from the isothermal softening curves, the time for which the tensile strength decreased by 10% from the initial value (tensile strength value before heating) by heating was determined. Next, the temperature and time at which the tensile strength decreased by 10% from the initial value (the time for which the tensile strength decreases by 10% from the initial value when heated at 300 deg C., 350 deg C. and 400 deg C.) were Arrhenius-plotted and the time at a temperature of 200 deg C. (the time when the tensile strength decreased by 10%) in the Arrhenius plot was determined. At this time, if the time at 200 deg C. in the Arrhenius plot was 10 years or more, it was determined as accepted (○), if the time at 200 deg C. is less than 10 years, it was determined as rejected (×). Note that in this measurement, it was assumed that all softening phenomena of 10% or less occurred at the same activation energies.

<Evaluation Results>

The SIM image of the alloy wire rod of Example 4 is shown in FIG. 1. In FIG. 1, the lateral direction corresponds to the longitudinal direction (wire drawing direction) of the alloy wire rod. According to FIG. 1, it was confirmed that a large number of Al crystal grains were formed. It was confirmed that most Al crystal grains are equiaxed crystal grains having a small aspect ratio. Further, with respect to the SIM image shown in FIG. 1, the distribution of crystal grain sizes was measured by image analysis processing, and as a result, coarse crystal grains having a length in the longitudinal direction exceeding 10 μm were also observed, but the area ratio occupied by the coarse crystal grains was as small as 3.3%, and mostly it was confirmed to be fine crystal grains having a size less than 10 μm.

Figure 2:
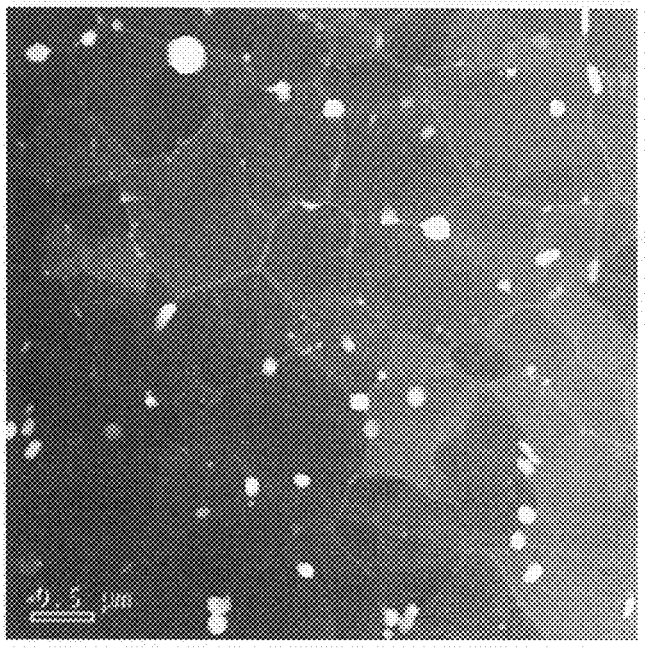
FIG. 2 is a dark-field image obtained by an STEM (scanning transmission electron microscope) of a cross section perpendicular to the longitudinal direction of the aluminum alloy wire rod of Example 4.

The STEM image of the alloy wire rod of Example 4 is shown in FIG. 2.

Figure 3:
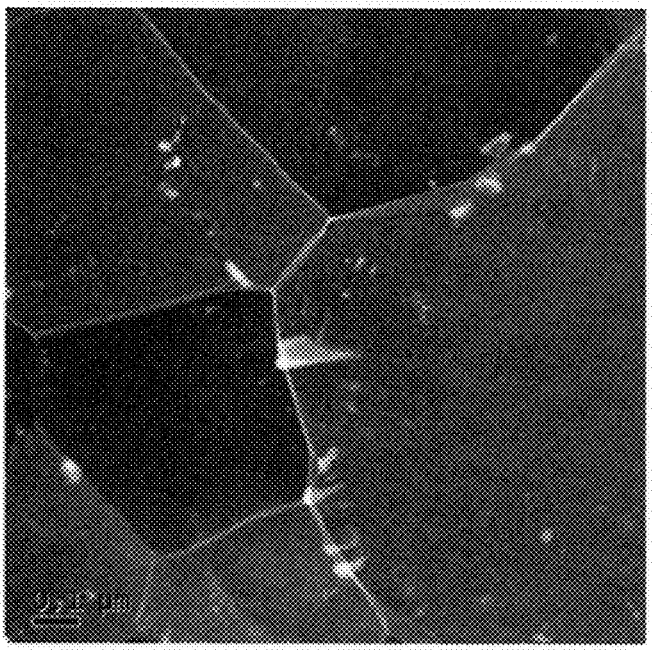
FIG. 3 is an enlarged view of FIG. 2.

According to FIG. 2, dispersion of round shaped particles (white) was confirmed. The size of round shaped particles was in the range of several tens to several hundreds of nm, and mainly distributed on the crystal grain boundaries. In the metal structure of FIG. 2, finer particles were also present than these round shaped particles. FIG. 3 shows a metal structure obtained by enlarging a part of the STEM image of FIG. 2. According to FIG. 3, it was confirmed that particles having a size of several tens gm were dispersed both at the crystal grain boundaries and in the grains. It was also found that the shapes of the particles observed in FIG. 3 were indefinite shapes such as a dot shape, a bar shape, a belt shape and the like.

In addition, in FIG. 2, when the chemical composition of the dispersed particles was measured by energy dispersion analysis (EDS), Co and Fe were detected in addition to Al from the round shaped particles. As a result of quantitative analysis of the EDS spectrum, it was found that the Fe content in the particles was smaller than the Co content. From these results, it was suggested that the round particles in FIG. 2 were AlCo compounds typified by the $Al_9Co_7$ phase, possibly being Al—Co—Fe compounds in which a part of Co was substituted with Fe. In addition, no Al—Fe compound phase containing only Fe but not Co, such as $Al_3Fe$ compounds, was confirmed.

In addition, when EDS analysis was performed on the fine irregularly shaped particles confirmed in FIG. 3, Zr was detected in addition to Al, but no Co and Fe were detected. From these results, it was found that these irregularly shaped fine particles were Al—Zr compounds typified by $Al_3Zr$.

In addition, in the alloy wire rod of Example 4, the number of particles of the round shaped Al—Co—Fe compound was 210 per 100 $\mu m^2$ on average in the five places. In addition, the number of particles of the irregularly shaped Al—Zr compound was 2,800 per 100 $\mu m^2$ on average in the 5 places.

Further, as shown in Table 1, it was confirmed that the alloy wire rod of Example 4 had the various characteristics at a high level in a well-balanced manner. Specifically, it was confirmed that the elongation was 12%, the tensile strength was 179 MPa, and the electrical conductivity was 56% IACS. In addition, it was confirmed that even when the alloy wire rod of Example 4 was heated at 200 deg C. for 10 years, the strength reduction due to heating was 10% or less from the initial state, and it was possible to maintain 90% or more of the initial strength and it was confirmed that it had high heat resistance. This was presumably because the Al recrystallized grains were small in the metal structure of the alloy wire rod and each compound of Al—Co—Fe and Al—Zr was finely dispersed.

In Examples 1 to 3 and 5 to 12, it was confirmed that the region occupied by the Al crystal grains having a crystal grain diameter of 10 μm or less was 90% or more in area ratio, and the fine crystal structure was formed. Specifically, the area occupied by coarse crystal grains having a crystal grain diameter exceeding 10 μm was less than 10% in area ratio in each case. Further, with respect to each example, STEM dark field images were examined, and it was confirmed that the Al—Co—Fe compound and the Al—Zr compound were dispersed in all cases. Further, it was confirmed that similarly to Example 4, the various properties were provided in a well-balanced manner at a high level.

Examples 13 to 15 are the results in the case of setting the solidification rate during casting from 25 deg C./s to 8, 12, 20 deg C./s in the alloys having the same chemical compositions as in Example 4. As the solidification rate decreased, the tensile strength gradually decreased. On the other hand, the electrical conductivity tended to increase as the solidification rate slowed down. This was considered to be because as the solidification rate increased, the crystallization of Zr during casting was suppressed, the amount of the supersaturated solid solution of Zr was increased, the precipitation of the Al—Zr compound during aging treatment was promoted, and the tensile strength was increased.

Figure 4:
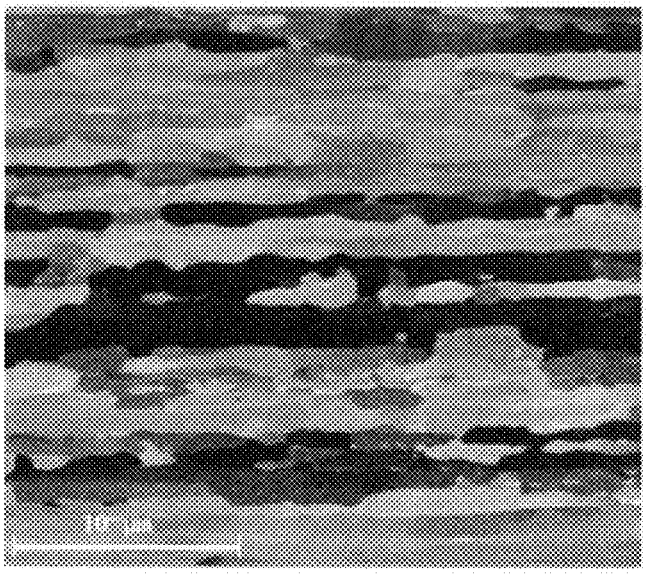
FIG. 4 is an SIM (secondary ion microscope) image of a cross section perpendicular to a longitudinal direction of an aluminum alloy wire rod of Comparative Example 1.
Figure 5:
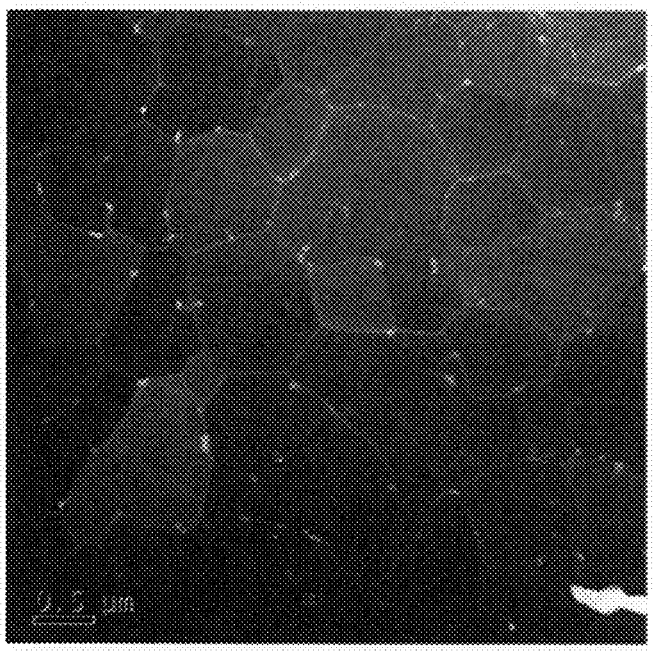
FIG. 5 is a dark field image obtained by the STEM (scanning transmission electron microscope) of a cross section perpendicular to the longitudinal direction of the aluminum alloy wire rod of Comparative Example 1.
Figure 6:
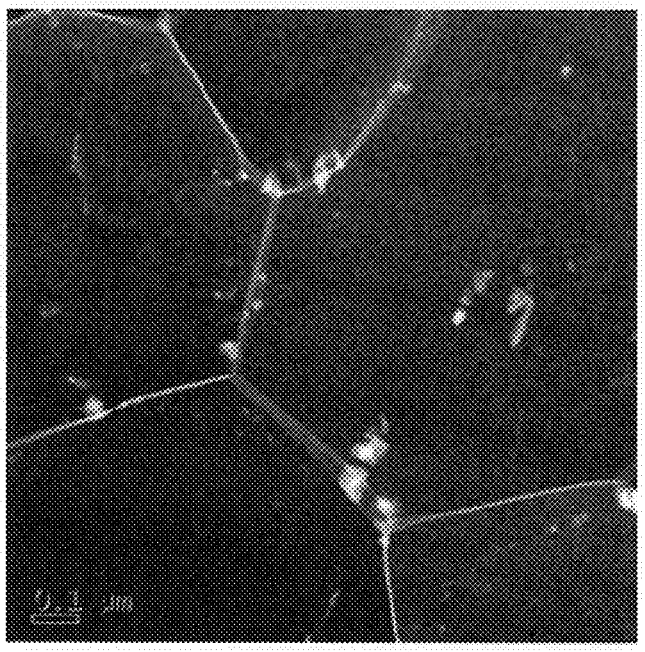
FIG. 6 is an enlarged view of FIG. 5.

In contrast, as shown in FIGS. 4 to 6, it was confirmed that no metal structure as in Example 1 was formed in the alloy wire rod of Comparative Example 1. FIG. 4 is an SIM (secondary ion microscope) image of a cross section perpendicular to the longitudinal direction of the aluminum alloy wire rod of Comparative Example 1. FIG. 5 is a dark field image obtained by an STEM (scanning transmission electron microscope) of a cross section perpendicular to the longitudinal direction of the aluminum alloy wire rod of Comparative Example 1. FIG. 6 is an enlarged view of FIG. 5.

According to FIG. 4, in the alloy wire rod of Comparative Example 1, most of the Al crystal grains had a shape with a large aspect ratio extending in the longitudinal direction. In the part of FIG. 4, coarse-sized crystal grains exceeding 10 μm were observed in the longitudinal direction. These crystal grains extending in the longitudinal direction were thought to be formed by grain boundaries easily moving in the longitudinal direction at the stage of recrystallization during aging heat treatment.

Further, with respect to the SIM image shown in FIG. 4, the distribution of crystal grain sizes was measured by image analysis processing, and it was confirmed that coarse crystal grains having a length exceeding 10 μm accounted for 44.7% of the entire observation region in area ratio, and the Al crystal grains were easily coarsened as compared with Example 1.

Further, according to the STEM image of Comparative Example 1 shown in FIG. 5, it was observed that no round shaped particles (Al—Co—Fe compound) as in Example 1 existed and that fine particles of 100 nm or less were dispersed at the crystal grain boundaries. According to FIG. 6, similarly to FIG. 3 of Example 1, it was observed that the irregular shaped particles having a size of the order of several tens to 100 μm were dispersed both at the crystal grain boundaries and in the grains.

The EDS analysis of the irregular shaped particles in FIG. 6 revealed that Zr was detected in addition to Al, but no Co and Fe were detected. From this result, it was found that these irregularly shaped particles were Al—Zr compounds typified by $Al_3Zr$. Although small in number, the presence of particles having a coarser size of the order of several hundreds of micrometers in which besides Al only Fe was detected was observed. It was speculated that the coarse particles containing only Fe were highly likely to be Al—Fe compounds such as $Al_3Fe$. That is, in the alloy wire rod of Comparative Example 1, it was presumed that the compounds dispersed in the metal structure were the Al—Zr compounds and a small number of Al—Fe compounds. The number density of the Al—Zr compounds was 3,300 per 100 $\mu m^2$ on average in the 5 places.

In addition, in the alloy wire rod of Comparative Example 1, it was confirmed that the elongation was 4%, the tensile strength was 149 MPa, and no desired mechanical properties were able to be obtained. This was presumably because no Al—Co—Fe compound was formed by adding no Co. Note that the heat resistance of Comparative Example 1 was determined as acceptable.

In Comparative Examples 2 and 3, the distribution of the crystal grain sizes of the SIM images was measured by image analysis processing, and it was confirmed that coarse crystal grains having a length exceeding 10 μm exceeded 20% of the entire observation region in area ratio. In Comparative Example 2, since no Zr was added, no Al—Zr compound was formed. For this reason, it was confirmed that although the elongation was high, the tensile strength remarkably decreased. On the other hand, in Comparative Example 3, no formation of the Al—Zr compound was confirmed since Zr was added, but it was as few as 0.1 mass %. Therefore, it was confirmed that no desired mechanical properties were able to be obtained as in Comparative Example 2. In addition, in the alloy wire rods of Comparative Examples 2 and 3, it was confirmed that the time until the strength when heated at 200 deg C. was less than 90% of the initial state strength (the time until the decrease in strength due to heating reached 10% or more) was less than 10 years, and the heat resistance was rejected. It was considered that this was because no Al—Zr compound was formed, so the heat resistance was decreased.

In Comparative Examples 4 to 9, it was confirmed that although Al crystal grains having a crystal grain diameter of 10 μm or less existed, the area ratio thereof was on the order of 80% but less than 90%. Also, it was confirmed that although Al—Co—Fe compounds and Al—Zr compounds were formed, the balance of the various properties was not good because the Co, Zr, Fe and Si contents were not appropriate. The heat resistance of each Example was determined as acceptable in any case.

Preferred Embodiments of the Present Invention

The preferred embodiments of the present invention will additionally be described below.

[Supplementary Note 1]

According to one embodiment of the present invention, there is provided a wire rod made of an aluminum alloy, the aluminum alloy having a chemical composition consisting of 0.1 to 1.0 mass % of Co, 0.2 to 0.5 mass % of Zr, 0.02 to 0.09 mass % of Fe, 0.02 to 0.09 mass % of Si, 0 to 0.2 mass % of Mg, 0 to 0.10 mass % of Ti, 0 to 0.03 mass % of B, 0 to 1.00 mass % of Cu, 0 to 0.50 mass % of Ag, 0 to 0.50 mass % of Au, 0 to 1.00 mass % of Mn, 0 to 1.00 mass % of Cr, 0 to 0.50 mass % of Hf, 0 to 0.50 mass % of V, 0 to 0.50 mass % of Sc, 0 to 0.50 mass % of Ni, the balance being Al and inevitable impurities, wherein the aluminum alloy has a metal structure including Al crystal grains, an Al—Co—Fe compound and an Al—Zr compound, and wherein an area ratio of a region occupied by the Al crystal grains having a crystal grain diameter of 10 μm or less is 90% or more.

[Supplementary Note 2]

In the aluminum alloy wire rod of Supplementary Note 1, preferably, in a cross section perpendicular to a longitudinal direction, the number of the Al—Zr compounds per unit area is 500/100 $\mu m^2$ or more.

[Supplementary Note 3]

In the aluminum alloy wire rod of Supplementary Note 1 or 2, preferably, in a cross section perpendicular to a longitudinal direction, the number of the Al—Co—Fe compounds per unit area is 50/100 $\mu m^2$ or more.

[Supplementary Note 4]

In the aluminum alloy wire rod of any one of Supplementary Notes 1 to 3, preferably, the Al—Co—Fe compound has a size of 20 nm or more and 500 nm or less.

[Supplementary Note 5]

In the aluminum alloy wire rod according to any one of Supplementary Notes 1 to 4, preferably, the Al—Zr compound has a size of 5 nm or more and 100 nm or less.

[Supplementary Note 6]

In the aluminum alloy wire rod according to any one of Supplementary Notes 1 to 5, preferably, the wire diameter is 2.0 nun or less.

[Supplementary Note 7]

In the aluminum alloy wire rod according to any one of Supplementary Notes 1 to 6, preferably, the Al—Co—Fe compound and the Al—Zr compound have a spherical shape.

[Supplementary Note 8]

In the aluminum alloy wire rod according to any one of Supplementary Notes 1 to 7, it is preferable that its tensile strength is 150 MPa or more, its conductivity is 55% IACS or more, and its strength when heated at 200 deg C. for 10 years is 90% or more of its initial state strength.

[Supplementary Note 9]

According to another aspect of the present invention, there is provided a method of producing a wire rod made of an aluminum alloy, the method comprising:

preparing a molten metal consisting of 0.1 to 1.0 mass % of Co, 0.2 to 0.5 mass % of Zr, 0.02 to 0.09 mass % of Fe, 0.02 to 0.09 mass % of Si, 0 to 0.2 mass % of Mg, 0 to 0.10 mass % of Ti, 0 to 0.03 mass % of B, 0 to 1.00 mass % of Cu, 0 to 0.50 mass % of Ag, 0 to 0.50 mass % of Au, 0 to 1.00 mass % of Mn, 0 to 1.00 mass % of Cr, 0 to 0.50 mass % of Hf, 0 to 0.50 mass % of V, 0 to 0.50 mass % of Sc, 0 to 0.50 mass % of Ni, the balance being Al and inevitable impurities;

casting the molten metal by quenching at such a cooling rate as to crystallize Co while suppressing crystallization of Zr, to form a cast material containing an Al—Co—Fe compound;

drawing the cast material to form a drawn wire rod; and subjecting the drawn wire rod to an aging treatment to precipitate Zr forming a solid solution in an Al phase as an Al—Zr compound, wherein the aluminum alloy has the above mentioned chemical composition and has a metal structure including Al crystal grains, an Al—Co—Fe compound and an Al—Zr compound, and wherein an area ratio of a region occupied by the Al crystal grains having a crystal grain diameter of 10 μm or less is 90% or more.

[Supplementary Note 10]

In the producing method of the aluminum alloy wire rod according to Supplementary Note 9, preferably, in the casting step, the cooling rate is set at 1 deg C./s or more and 60 deg C./s or less.

[Supplementary Note 11]

In the method for producing an aluminum alloy wire rod according to Supplementary Note 9 or 10, preferably, in the cast material drawing step, the cast material is drawn at such a degree of processing that its cross-sectional area is 0.01 times or less.

[Supplementary Note 12]

In the method for producing an aluminum alloy wire rod according to any one of Supplementary Notes 9 to 11, preferably, in the cast material drawing step, the wire diameter of the drawn wire rod is set at 2.0 mm or less.

[Supplementary Note 13]

According to one aspect of the present invention, there is provided a wire rod made of an aluminum alloy, the aluminum alloy having a chemical composition consisting of 0.1 to 1.0 mass % of Co, 0.2 to 0.5 mass % of Zr, 0.02 to 0.09 mass % of Fe, 0.02 to 0.09 mass % of Si, 0 to 0.2 mass % of Mg, 0 to 0.10 mass % of Ti, 0 to 0.03 mass % of B, 0 to 1.00 mass % of Cu, 0 to 0.50 mass % of Ag, 0 to 0.50 mass % of Au, 0 to 1.00 mass % of Mn, 0 to 1.00 mass % of Cr, 0 to 0.50 mass % of Hf, 0 to 0.50 mass % of V, 0 to 0.50 mass % of Sc, 0 to 0.50 mass % of Ni, the balance being Al and inevitable impurities, wherein the aluminum alloy has a metal structure including Al crystal grains, an Al—Co—Fe compound and an Al—Zr compound, and wherein the wire rod has a tensile strength of 150 MPa or more, an electrical conductivity of 55% IACS or more and when heated at 200 deg C. for 10 years, a strength of 90% or more of its initial state strength.

[Supplementary Note 14]

In the aluminum alloy wire rod of Supplementary Note 13, preferably, the metal structure has an area ratio of a region occupied by the Al crystal grains having a crystal grain diameter of 10 μm or less of 90% or more.

[Supplementary Note 15]

In the aluminum alloy wire rod of Supplementary Note 13 or 14, preferably, in a cross section perpendicular to a longitudinal direction, the number of the Al—Zr compounds per unit area is 500/100 $\mu m^2$ or more.

[Supplementary Note 16]

In the aluminum alloy wire rod of any one of Supplementary Notes 13 to 15, preferably, in a cross section perpendicular to a longitudinal direction, the number of the Al—Co—Fe compounds per unit area is 50/100 $\mu m^2$ or more.

[Supplementary Note 17]

In the aluminum alloy wire rod of any one of Supplementary Notes 13 to 16, preferably, the Al—Co—Fe compound has a size of 20 nm or more and 500 nm or less.

[Supplementary Note 18]

In the aluminum alloy wire rod of any one of Supplementary Notes 13 to 17, preferably, the Al—Zr compound has a size of 5 nm or more and 100 nm or less.

[Supplementary Note 19]

In the aluminum alloy wire rod of any one of Supplementary Notes 13 to 18, preferably, the wire diameter is 2.0 mm or less.

[Supplementary Note 20]

In the aluminum alloy wire rod of any one of Supplementary Notes 13 to 19, preferably, the Al—Co—Fe compound and the Al—Zr compound have a spherical shape.

[Supplementary Note 21]

According to another aspect of the present invention, there is provided a method of producing a wire rod made of an aluminum alloy, the method comprising:

preparing a molten metal consisting of 0.1 to 1.0 mass % of Co, 0.2 to 0.5 mass % of Zr, 0.02 to 0.09 mass % of Fe, 0.02 to 0.09 mass % of Si, 0 to 0.2 mass % of Mg, 0 to 0.10 mass % of Ti, 0 to 0.03 mass % of B, 0 to 1.00 mass % of Cu, 0 to 0.50 mass % of Ag, 0 to 0.50 mass % of Au, 0 to 1.00 mass % of Mn, 0 to 1.00 mass % of Cr, 0 to 0.50 mass % of Hf, 0 to 0.50 mass % of V, 0 to 0.50 mass % of Sc, 0 to 0.50 mass % of Ni, the balance being Al and inevitable impurities;

casting the molten metal by quenching at such a cooling rate as to crystallize Co while suppressing crystallization of Zr, to form a cast material containing an Al—Co—Fe compound;

drawing the cast material to form a drawn wire rod; and subjecting the drawn wire rod to an aging treatment to precipitate Zr forming a solid solution in an Al phase as an Al—Zr compound, wherein the aluminum alloy has the above mentioned chemical composition and has a metal structure including Al crystal grains, an Al—Co—Fe compound and an Al—Zr compound, wherein the wire rod has a tensile strength of 150 MPa or more, an electrical conductivity of 55% IACS or more and when heated at 200 deg C. for 10 years, a strength of 90% or more of its initial state strength.

[Supplementary Note 22]

In the method for producing an aluminum alloy wire rod according to Supplementary Note 9, preferably, the metal structure has a maximum value of a recrystallized grain diameter of the Al crystal grains of 10 μm or less.

[Supplementary Note 23]

In the method for producing an aluminum alloy wire rod according to Supplementary Note 21 or 22, preferably, in the casting step, the cooling rate is 1 deg C./s or more and 60 deg C./s or less.

[Supplementary Note 24]

In the method for producing an aluminum alloy wire rod according to any one of Supplementary Notes 21 to 23, preferably, in the cast material drawing step, the cast material is drawn at such a degree of processing that its cross-sectional area is 0.01 times or less.

[Supplementary Note 25]

In the method for producing an aluminum alloy wire rod according to any one of Supplementary Notes 21 to 24, preferably, in the cast material drawing step, the wire diameter of the drawn wire rod is set at 2.0 mm or less.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A wire rod made of an aluminum alloy, the aluminum alloy having a chemical composition consisting of 0.1 to 1.0 mass % of Co, 0.2 to 0.5 mass % of Zr, 0.02 to 0.09 mass % of Fe, 0.02 to 0.09 mass % of Si, 0 to 0.2 mass % of Mg, 0 to 0.10 mass % of Ti, 0 to 0.03 mass % of B, 0 to 1.00 mass % of Cu, 0 to 0.50 mass % of Ag, 0 to 0.50 mass % of Au, 0 to 1.00 mass % of Mn, 0 to 1.00 mass % of Cr, 0 to 0.50 mass % of Hf, 0 to 0.50 mass % of V, 0 to 0.50 mass % of Sc, 0 to 0.50 mass % of Ni, the balance being Al and inevitable impurities, wherein the aluminum alloy has a metal structure including Al crystal grains, an Al—Co—Fe compound and an Al—Zr compound, and wherein an area ratio of a region occupied by the Al crystal grains having a crystal grain diameter of 10 μm or less is 90% or more.

2. The aluminum alloy wire rod according to claim 1, wherein in a cross section perpendicular to a longitudinal direction, the number of the Al—Zr compounds per unit area is 500/100 $\mu m^2$ or more.

3. The aluminum alloy wire rod according to claim 1, wherein in a cross section perpendicular to a longitudinal direction, the number of the Al—Co—Fe compounds per unit area is 50/100 $\mu m^2$ or more.

4. The aluminum alloy wire rod according to claim 1, wherein the Al—Co—Fe compound has a size of 20 nm or more and 500 nm or less.

5. The aluminum alloy wire rod according to claim 1, wherein the Al—Zr compound has a size of 5 nm or more and 100 nm or less.

6. The aluminum alloy wire rod according to claim 1, wherein the wire diameter is 2.0 mm or less.

7. The aluminum alloy wire rod according to claim 1, wherein the Al—Co—Fe compound and the Al—Zr compound have a spherical shape.

8. The aluminum alloy wire rod according to claim 1, wherein its tensile strength is 150 MPa or more, its conductivity is 55% IACS or more, and its strength when heated at 200 deg C. for 10 years is 90% or more of its initial state strength.

9. A method of producing a wire rod made of an aluminum alloy, the method comprising:

preparing a molten metal consisting of 0.1 to 1.0 mass % of Co, 0.2 to 0.5 mass % of Zr, 0.02 to 0.09 mass % of Fe, 0.02 to 0.09 mass % of Si, 0 to 0.2 mass % of Mg, 0 to 0.10 mass % of Ti, 0 to 0.03 mass % of B, 0 to 1.00 mass % of Cu, 0 to 0.50 mass % of Ag, 0 to 0.50 mass % of Au, 0 to 1.00 mass % of Mn, 0 to 1.00 mass % of Cr, 0 to 0.50 mass % of Hf, 0 to 0.50 mass % of V, 0 to 0.50 mass % of Sc, 0 to 0.50 mass % of Ni, the balance being Al and inevitable impurities;

casting the molten metal by quenching at such a cooling rate as to crystallize Co while suppressing crystallization of Zr, to form a cast material containing an Al—Co—Fe compound;

drawing the cast material to form a drawn wire rod; and subjecting the drawn wire rod to an aging treatment to precipitate Zr forming a solid solution in an Al phase as an Al—Zr compound, wherein the aluminum alloy has the above mentioned chemical composition and has a metal structure including Al crystal grains, an Al—Co—Fe compound and an Al—Zr compound, and wherein an area ratio of a region occupied by the Al crystal grains having a crystal grain diameter of 10 μm or less is 90% or more.

10. The method for producing an aluminum alloy wire rod according to claim 9, wherein in the casting step, the cooling rate is 1 deg C./s or more and 60 deg C./s or less.

11. The method for producing an aluminum alloy wire rod according to claim 9, wherein in the cast material drawing step, the cast material is drawn at such a degree of processing that its cross-sectional area is 0.01 times or less.

12. The method of producing an aluminum alloy wire rod according to claim 9, wherein, in the cast material drawing step, the wire diameter of the drawn wire rod is set at 2.0 mm or less.

13. A wire rod made of an aluminum alloy, the aluminum alloy having a chemical composition consisting of 0.1 to 1.0 mass % of Co, 0.2 to 0.5 mass % of Zr, 0.02 to 0.09 mass % of Fe, 0.02 to 0.09 mass % of Si, 0 to 0.2 mass % of Mg, 0 to 0.10 mass % of Ti, 0 to 0.03 mass % of B, 0 to 1.00 mass % of Cu, 0 to 0.50 mass % of Ag, 0 to 0.50 mass % of Au, 0 to 1.00 mass % of Mn, 0 to 1.00 mass % of Cr, 0 to 0.50 mass % of Hf, 0 to 0.50 mass % of V, 0 to 0.50 mass % of Sc, 0 to 0.50 mass % of Ni, the balance being Al and inevitable impurities, wherein the aluminum alloy has a metal structure including Al crystal grains, an Al—Co—Fe compound and an Al—Zr compound, and wherein the wire rod has a tensile strength of 150 MPa or more, an electrical conductivity of 55% IACS or more and when heated at 200 deg C. for 10 years, a strength of 90% or more of its initial state strength.

14. The aluminum alloy wire rod according to claim 13, wherein the metal structure has an area ratio of a region occupied by the Al crystal grains having a crystal grain diameter of 10 μm or less of 90% or more.

15. The aluminum alloy wire rod according to claim 13, wherein in a cross section perpendicular to a longitudinal direction, the number of the Al—Zr compounds per unit area is 500/100 $\mu m^2$ or more.

16. The aluminum alloy wire rod according to claim 13, wherein in a cross section perpendicular to a longitudinal direction, the number of the Al—Co—Fe compounds per unit area is 50/100 $\mu m^2$ or more.

17. The aluminum alloy wire rod according to claim 13, wherein the Al—Co—Fe compound has a size of 20 nm or more and 500 nm or less.

18. The aluminum alloy wire rod according to claim 13, wherein the Al—Zr compound has a size of 5 nm or more and 100 nm or less.

19. The aluminum alloy wire rod according to claim 13, wherein the wire diameter is 2.0 mm or less.

20. The aluminum alloy wire rod according to claim 13, wherein the Al—Co—Fe compound and the Al—Zr compound have a spherical shape.

21. A method of producing a wire rod made of an aluminum alloy, the method comprising:

preparing a molten metal consisting of 0.1 to 1.0 mass % of Co, 0.2 to 0.5 mass % of Zr, 0.02 to 0.09 mass % of Fe, 0.02 to 0.09 mass % of Si, 0 to 0.2 mass % of Mg, 0 to 0.10 mass % of Ti, 0 to 0.03 mass % of B, 0 to 1.00 mass % of Cu, 0 to 0.50 mass % of Ag, 0 to 0.50 mass % of Au, 0 to 1.00 mass % of Mn, 0 to 1.00 mass % of Cr, 0 to 0.50 mass % of Hf, 0 to 0.50 mass % of V, 0 to 0.50 mass % of Sc, 0 to 0.50 mass % of Ni, the balance being Al and inevitable impurities;

casting the molten metal by quenching at such a cooling rate as to crystallize Co while suppressing crystallization of Zr, to form a cast material containing an Al—Co—Fe compound;

drawing the cast material to form a drawn wire rod; and subjecting the drawn wire rod to an aging treatment to precipitate Zr forming a solid solution in an Al phase as an Al—Zr compound, wherein the aluminum alloy has the above mentioned chemical composition and has a metal structure including Al crystal grains, an Al—Co—Fe compound and an Al—Zr compound, wherein the wire rod has a tensile strength of 150 MPa or more, an electrical conductivity of 55% IACS or more and when heated at 200 deg C. for 10 years, a strength of 90% or more of its initial state strength.

22. The method for producing an aluminum alloy wire rod according to claim 21, wherein the metal structure has an area ratio of a region occupied by the Al crystal grains having a crystal grain diameter of 10 μm or less of 90% or more.

23. The method for producing an aluminum alloy wire rod according to claim 21, wherein in the casting step, the cooling rate is 1 deg C./s or more and 60 deg C./s or less.

24. The method of producing an aluminum alloy wire rod according to claim 21, wherein, in the cast material drawing step, the cast material is drawn at such a degree of processing that its cross-sectional area is 0.01 times or less.

25. The method of producing an aluminum alloy wire rod according to claim 21, wherein, in the cast material drawing step, the wire diameter of the drawn wire rod is set at 2.0 mm or less.

* * * * *